US010001282B2

(12) United States Patent
Ozbek

(10) Patent No.: US 10,001,282 B2
(45) Date of Patent: Jun. 19, 2018

(54) HOUSEHOLD APPLIANCE

(75) Inventor: Mehmet Ozbek, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 304 days.

(21) Appl. No.: 11/574,130

(22) PCT Filed: Aug. 25, 2005

(86) PCT No.: PCT/IB2005/052794

§ 371 (c)(1),
(2), (4) Date: Feb. 22, 2007

(87) PCT Pub. No.: WO2006/021936

PCT Pub. Date: Mar. 2, 2006

(65) Prior Publication Data

US 2009/0121970 A1 May 14, 2009

(30) Foreign Application Priority Data

Aug. 27, 2004 (TR) ..... 2004 02150

(51) Int. Cl.

| | |
|---|---|
| ***G09G 3/34*** | (2006.01) |
| ***D06F 39/14*** | (2006.01) |
| ***F24C 7/08*** | (2006.01) |
| ***D06F 37/28*** | (2006.01) |
| ***D06F 39/00*** | (2006.01) |
| ***G09F 9/35*** | (2006.01) |

(52) U.S. Cl.

CPC ..... *F24C 7/082* (2013.01); *D06F 37/28* (2013.01); *D06F 39/005* (2013.01); *D06F 39/14* (2013.01); *G09F 9/35* (2013.01); *D06F 2216/00* (2013.01); *G09G 3/34* (2013.01)

(58) Field of Classification Search

CPC ... G09G 3/16; G09G 3/18; G09G 3/34; F24C 7/082; D06F 37/28; D06F 39/005; D06F 39/14; D06F 2216/00; G09F 9/35

See application file for complete search history.

(56) References Cited

U.S. PATENT DOCUMENTS

| | | | | |
|---|---|---|---|---|
| 3,898,977 | A * | 8/1975 | Draper | 126/200 |
| 4,363,315 | A * | 12/1982 | von Blanquet | F24C 15/04 126/19 R |
| 4,927,240 | A * | 5/1990 | Stolov et al. | 349/81 |
| 5,570,597 | A * | 11/1996 | Bongini | D06F 37/22 68/139 |
| 5,589,958 | A * | 12/1996 | Lieb | 349/16 |
| 5,796,454 | A * | 8/1998 | Ma | 349/98 |

(Continued)

FOREIGN PATENT DOCUMENTS

| | | |
|---|---|---|
| DE | 299 19 792 U1 | 1/2000 |
| EP | 1 207 353 A | 5/2002 |

(Continued)

OTHER PUBLICATIONS

Machine translation of JP2001-133130.*
European Search Report dated Feb. 17, 2009 from corresponding Turkish application 05 781 449.3 (three pages).

*Primary Examiner* — Antonio Xavier
(74) *Attorney, Agent, or Firm* — Kilpatrick Townsend & Stockton LLP

(57) ABSTRACT

This invention relates to a household appliance (1) comprising a display unit (6) installed thereon.

6 Claims, 4 Drawing Sheets

(56) References Cited

U.S. PATENT DOCUMENTS

| | | | | |
|---|---|---|---|---|
| 6,039,390 | A * | 3/2000 | Agrawal et al. | 296/211 |
| 6,294,258 | B1 * | 9/2001 | Gentile | 428/412 |
| 6,430,946 | B2 | 8/2002 | Roh et al. | |
| 6,457,286 | B1 * | 10/2002 | Eliyahu et al. | 52/171.3 |
| 6,559,427 | B1 * | 5/2003 | Barnes et al. | 219/486 |
| 6,671,008 | B1 * | 12/2003 | Li et al. | 349/16 |
| 6,692,093 | B1 | 2/2004 | Park et al. | |
| 6,785,561 | B1 * | 8/2004 | Kim | 455/566 |
| 6,809,295 | B1 * | 10/2004 | Vargas | 219/393 |
| 2002/0007486 | A1 | 1/2002 | Yun | |
| 2002/0043261 | A1 * | 4/2002 | Leutner et al. | 126/388.1 |
| 2002/0180344 | A1 * | 12/2002 | Lichtfuss | 313/498 |
| 2003/0038912 | A1 * | 2/2003 | Broer et al. | 349/122 |
| 2003/0112414 | A1 * | 6/2003 | Yoshioka et al. | 353/31 |
| 2003/0214792 | A1 * | 11/2003 | Credelle et al. | 361/760 |
| 2004/0019515 | A1 * | 1/2004 | Senyurt | 705/9 |
| 2004/0089031 | A1 * | 5/2004 | Kim et al. | 68/196 |
| 2004/0109096 | A1 * | 6/2004 | Anderson et al. | 348/832 |
| 2004/0156170 | A1 * | 8/2004 | Mager et al. | 361/683 |
| 2004/0160388 | A1 * | 8/2004 | O'Keeffe | 345/30 |
| 2005/0034486 | A1 * | 2/2005 | Bienick et al. | 68/3 R |
| 2005/0183470 | A1 * | 8/2005 | Kim et al. | 68/12.03 |
| 2006/0000110 | A1 * | 1/2006 | Aisenberg | A47K 10/48 34/443 |
| 2007/0024822 | A1 * | 2/2007 | Cortenraad et al. | 353/79 |

FOREIGN PATENT DOCUMENTS

| | | | |
|---|---|---|---|
| EP | 1 207 353 | A2 | 5/2002 |
| JP | 09061045 | A | 7/1997 |
| JP | 2001133130 | | 5/2001 |
| KR | 2002-0036508 | A | 5/2002 |
| WO | 02/14593 | A2 | 2/2002 |
| WO | 2004/057636 | A1 | 7/2004 |

* cited by examiner

[Fig. 001]
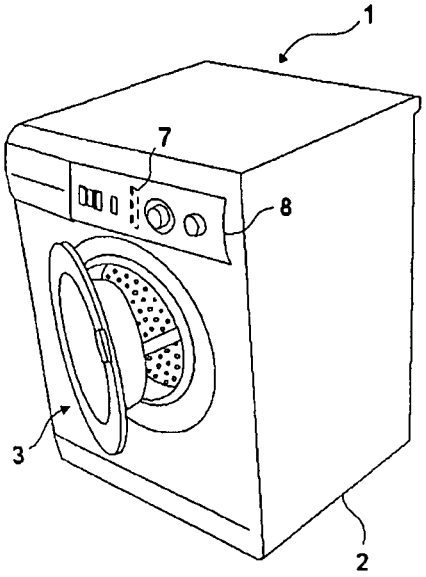
[Fig. 002]
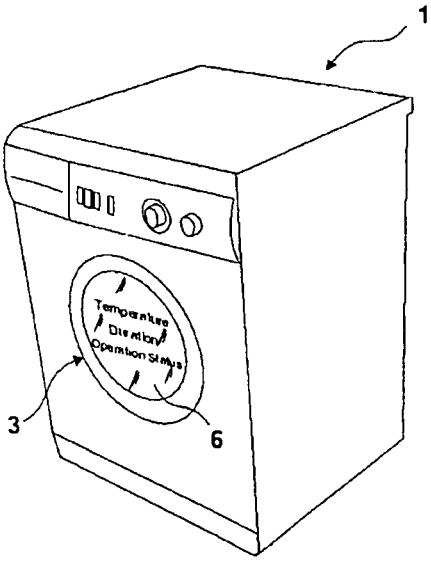

[Fig. 003]
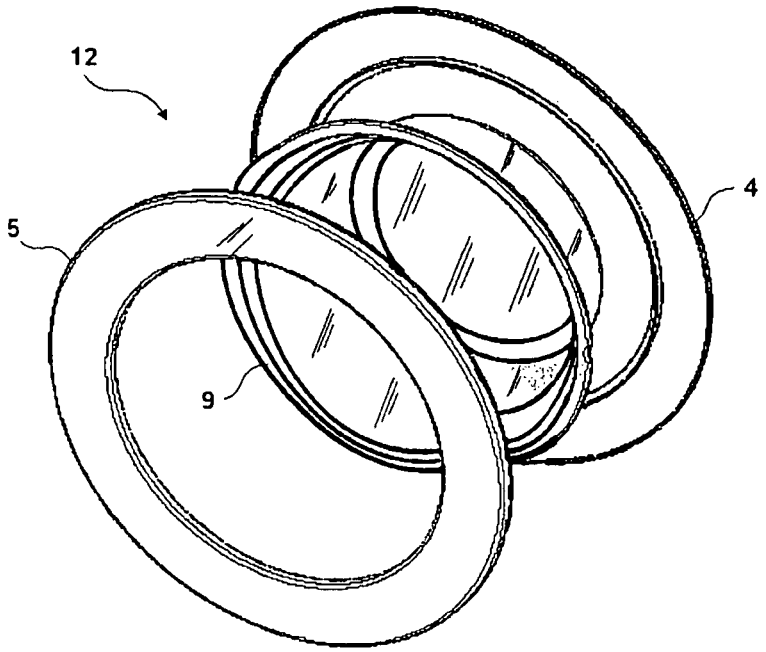
[Fig. 004]
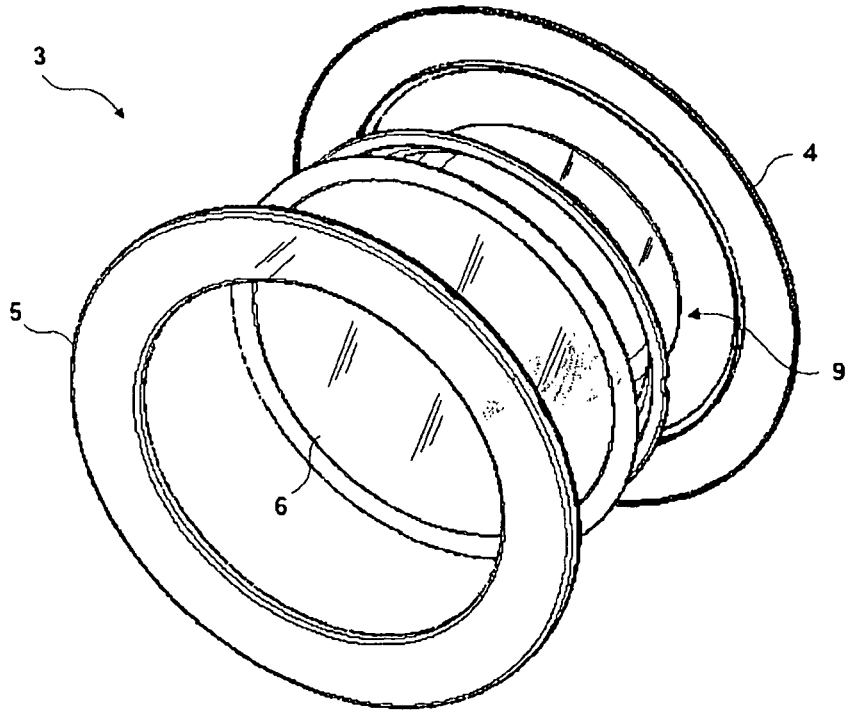

[Fig. 005]
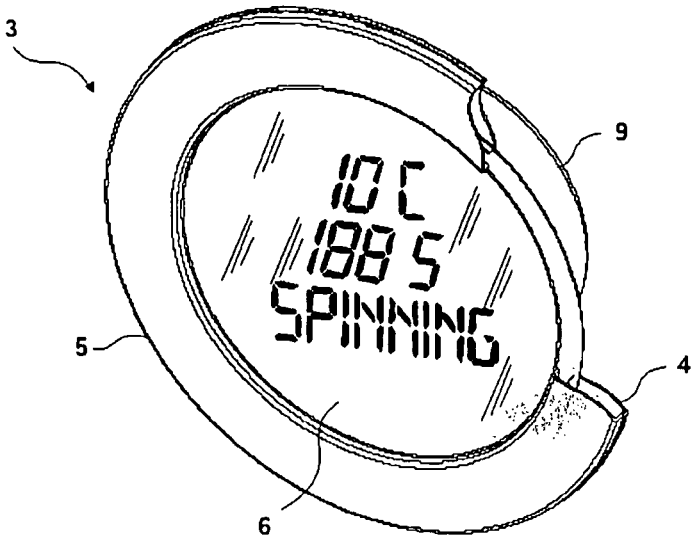
[Fig. 006]
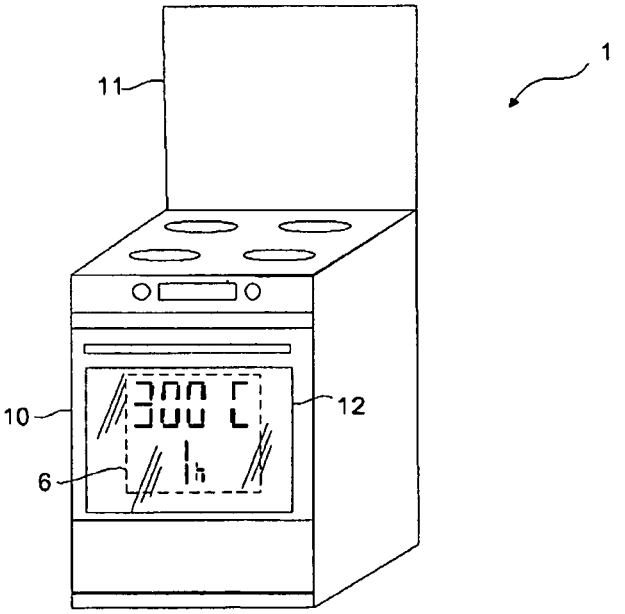

[Fig. 007]
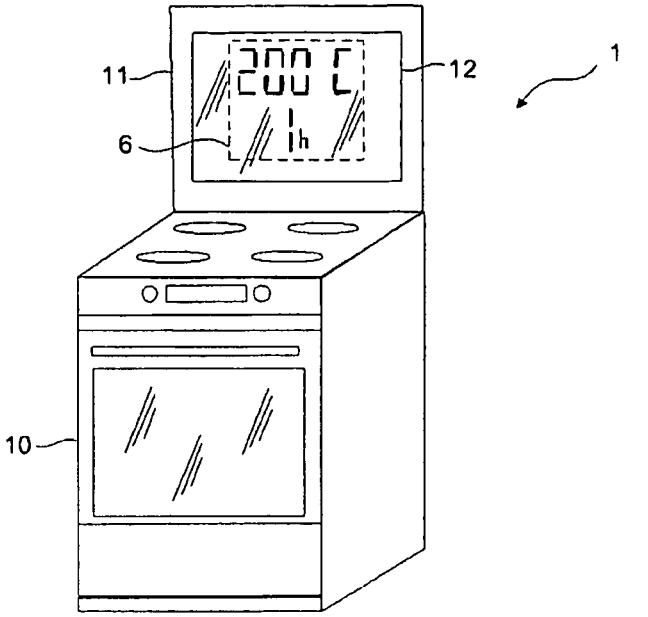

HOUSEHOLD APPLIANCE

This invention relates to a household appliance comprising a display unit which enables the user to easily follow the operation status thereof.

In almost all household appliances, for example washing machines, clothes dryers, dishwashers, cooking appliances and coolers, there are display units enabling the display of the information allowing the user to monitor the operation status of the appliance and to control the appliance more easily preferably liquid crystal display units are employed as display. In the current state of the art, employment of transparent or semi-transparent LCDs which partially or fully allow light to pass through is known.

LCDs are preferably positioned on the appliance within a control panel which also includes the control keys by which the user can control operation of appliance. Although the information displayed on the LCD engaged on the control panel is in viewable size when user is near the appliance, information displayed on the LCD cannot be easily viewed when user goes away from the appliance.

Various methods have been developed for easy viewing of the operation status of the appliance by the user.

In the current state of the art, in the European Patent Application no. 1207353, an apparatus is described wherein the operation status information is reflected on a wall by means of a projection device.

In another state of the art, in the United States Patent Application no. 2002007486 and U.S. Pat. Nos. 6,692,093 and 6,430,946, LCD screens positioned on a cooling apparatus is described.

In another state of the art, in the International Patent Application no. 200214593 WO2002/014593, a control and display panel on the door of a front-load washing machine which enables user to monitor operation steps from a distance is described.

In another state of the art, in the International Patent Application no. 2004057636, a device which displays the operation status of the appliance to the user by implementing various colour signals is described.

The object of this invention is the realisation of a household appliance comprising a display unit which allows the user to easily view the operation status of the appliance.

The household appliance designed to fulfill the object of the present invention is illustrated in the attached figures wherein:

FIG. 1—is the perspective view of a washer dryer in the preferred embodiment of the present invention.

FIG. 2—is the perspective view of a washer dryer when the display is active.

FIG. 3—is the exploded view of a window.

FIG. 4—is the exploded view of washer dryer door.

FIG. 5—is the perspective view of a washer dryer door.

FIG. 6—is the perspective view of an active display unit disposed on the front door of a cooking appliance in an alternative embodiment of the present invention.

FIG. 7—is the perspective view of an active display unit disposed on the upper door of a cooking appliance in an alternative embodiment of the present invention.

The elements shown in figures are numbered as follows:

1. Household appliance
2. Body
3. Door
4. Inner frame
5. Outer frame
6. Display unit
7. Control card

8. Control panel
9. Panel
10. Front door
11. Upper door
12. Window The household appliance (1) which is the object of the present invention, for example a washer dryer (washing machines, clothes dryers and dishwashers), a cooking appliance or a cooling appliance, comprises a body (2), a door (3) attached on the body (1) enabling user to have access inside the body (2), a window (12) positioned on the body (2) and/or the door (3) allowing user to view interior of the body (2), a hinge enabling the door (3) to be installed on the body (2) and the opening and closing of it, a control panel (8) comprising a data entry unit like buttons, keys or a keypad and a display, a screen or the like data output unit enabling the user to control the household appliance (1), a control card (7) enabling the control of the household appliance (1), and unlike data output unit on control panel (8), a display unit (6) secured on the window (12) allowing the user to monitor simultaneously the interior of the body (2) through the window (12) and the data delivered by the control card (7) (all the data relating to the appliance and the current condition of the appliance like temperature, duration, operation status-of-appliance etc.).

The data exchange between the display unit (6) installed on the household appliance (1) and the control card (7) which processes data to be displayed on the display unit (6) can be accomplished through mechanical and electrical connections like cable connections etc. as well as by employing state of the art wireless data exchange methods (infrared, radio signal, bluetooth etc.) without the need for mechanical connections.

For the purpose of monitoring interior of the household appliance (1) by the user, the window (12) is produced prefer ably of glass or a similar transparent material that allows light to pass through.

The display unit (6) is produced of a transparent or semi-transparent material enabling the user to view behind the display unit (6).

LCD is preferably employed as the display unit (6) because it exhibits a transparent characteristic which lets the light pass through. The display unit (6) comprises a liquid crystal material placed between two glass panels and isolated from outer medium and at least one guider or polarizer placed in double layer on the glass panels which filters and thus directs the light and at least one light source.

In the preferred embodiment of the present invention, the transparent display unit (6) is disposed on the door (3) to enable the user to monitor interior of the household appliance (1). The display unit (6) is engaged on the door (3) by the state of the art attachment methods like fixing elements or snap-fitting method or adhesion. The (3) having the display unit (6) mounted on it is installed on the body (2) by means of a hinge. The display unit (6) as well as being engaged on the door (3) may also be engaged on the window (12) which is on the body (2) and which is made of a transparent or semi transparent material allowing the user to monitor interior of the household appliance (1) or the current condition of the household appliance (1). Thus, while the user monitors the interior of the house appliance (1), the data related to the household appliance (1) like operation status, current program, remaining time etc. may also be monitored.

In the preferred embodiment of the household appliance (1), which is the object of the present invention, a washer dryer specifically a washing machine is employed. The door (3) of the washing machine comprises an inner frame (4), an outer frame (5) and a panel (9) interposed between the inner frame (4) and the outer frame (5) preferably made of glass. A display unit (6) utilizing transparent LCD is engaged between the panel (9) and the outer frame (5). Display unit (6) engaged between the panel (9) and the outer frame (5) is mounted on the inner frame (4) by way of various attachment methods to form the washing machine door (3). The door (3) is fixed on the body (2) by a hinge and data exchange between the display unit (6) and the control card (7) is provided by an electrical connection (FIG. 1, FIG. 2, FIG. 3, FIG. 4 and FIG. 5).

In an alternative embodiment of the present invention, the display unit (6) is mounted preferably on the front door (10) allowing access to the cooking chamber (FIG. 6) or on the window (12) on the upper door (11) (FIG. 7) covering the hob.

The household appliance (1) which is the object of the present invention enables the user to monitor the data compiled in the control card (7) from a distance, without any need to come near the household appliance (1) as well as offering the user the option of viewing the interior of the household appliance (1) and also endowing the household appliance (1) with a more aesthetic appearance.

The invention claimed is:

1. A household appliance utilized as a washer/dryer comprising:

a body, a door attached on the body forming an interior, wherein the door comprises an inner frame, an outer frame, and a panel interposed between the inner frame and the outer frame, a window positioned on the body or on the door allowing monitoring of the interior, a control card enabling control of the household appliance, a display unit engaged between the panel and the outer frame of the door, wherein the display unit receives data related to the household appliance from the control card, wherein the display unit is isolated from the interior by mounting on the window, wherein the display unit simultaneously displays the data related to the household appliance delivered by the control card and shows the interior of the body, wherein the data includes temperature, operation status and remaining time for a current operation of the household appliance, and a control panel separate from the display unit, wherein the control panel includes a data entry unit to receive input for controlling the operation of the household appliance.

2. A household appliance according to claim 1, wherein the display unit is produced of a transparent or semi-transparent material that enables viewing of the interior.

3. A household appliance according to claim 1 or 2, wherein the display unit employs LCD displaying data selected from the group consisting of temperature, duration, operation status, current program, remaining time and combinations thereof.

4. A household appliance utilized as a washer/dryer comprising:

a body, a door attached on the body forming an interior, wherein the door comprises an inner frame, an outer frame, and a panel interposed between the inner frame and the outer frame, a window positioned on the body or on the door allowing monitoring of the interior, a control card enabling control of the household appliance, and a display unit comprising at least one light source and a liquid crystal material placed between two glass panels and at least one polarizer placed in a double layer on the glass panels which filters and directs the light, wherein the display unit is engaged between the panel and the outer frame of the door, wherein the display unit receives data related to the household appliance from the control card, wherein the display unit is mounted on the window, wherein the display unit simultaneously displays the data related to the household appliance delivered by the control card and shows the interior of the body, wherein the data includes temperature, operation status and remaining time for a current operation of the household appliance, and a control panel separate from the display unit, wherein the control panel includes a data entry unit to receive input for controlling the operation of the household appliance.

5. A household appliance according to claim 4, wherein the display unit is produced of a transparent or semi-transparent material that enables viewing of the interior.

6. The household appliance according to claim 4 or 5, wherein the display unit employs LCD displaying data selected from the group consisting of temperature, duration, operation status, current program, remaining time and combinations thereof.

* * * * *